US006799693B2

(12) United States Patent
Meza

(10) Patent No.: US 6,799,693 B2
(45) Date of Patent: Oct. 5, 2004

(54) FOLD UP INSULATED BOTTLE HOLDER

(76) Inventor: Robert B. Meza, 1011 Ennis Joslin Rd., #127, Corpus Christi, TX (US) 78412

( * ) Notice: Subject to any disclaimer, the term of this patent is extended or adjusted under 35 U.S.C. 154(b) by 206 days.

(21) Appl. No.: 10/173,217

(22) Filed: Jun. 18, 2002

(65) Prior Publication Data

US 2003/0230511 A1 Dec. 18, 2003

(51) Int. Cl.[7] ..... B65D 25/34
(52) U.S. Cl. ..... 220/739; 220/212; 220/740
(58) Field of Search ..... 206/545; 220/739, 220/737, 738, 740, 741, 742, 375, 380, 902, 903

(56) References Cited

U.S. PATENT DOCUMENTS

| | | | | |
|---|---|---|---|---|
| 3,905,511 A | | 9/1975 | Groendal | |
| 4,194,627 A | | 3/1980 | Christensen | |
| 4,474,303 A | * | 10/1984 | Maccise | 206/545 |
| 4,648,525 A | | 3/1987 | Henderson | |
| 4,872,577 A | | 10/1989 | Smith | |
| 5,048,734 A | | 9/1991 | Long | |
| 5,169,025 A | | 12/1992 | Guo | |
| 5,186,350 A | | 2/1993 | McBride | |
| 5,251,460 A | * | 10/1993 | DeMarco et al. | 220/903 |
| 5,261,554 A | | 11/1993 | Forbes | |
| 5,740,940 A | | 4/1998 | Weiss | |
| 5,740,951 A | | 4/1998 | Jack | |
| 5,765,712 A | | 6/1998 | Skinner et al. | |
| 5,775,530 A | * | 7/1998 | Attaway | 220/902 |
| 5,845,806 A | | 12/1998 | Parchman | |
| 6,073,796 A | * | 6/2000 | Mogil | 220/739 |
| 6,349,846 B1 | | 2/2002 | Meza | |

OTHER PUBLICATIONS

An Insulated Can Holder as Shown in the attached five (5) photographs.

* cited by examiner

*Primary Examiner*—Luan K. Bui
(74) *Attorney, Agent, or Firm*—G. Turner Moller

(57) ABSTRACT

An insulated holder for a bottle is made of a bodily flexible foam material having a lower sleeve for receiving the bottom of the bottle. A lid is attached to the lower sleeve and is movable from a position covering the open top of the lower sleeve to a vertical position. An upper sleeve is attached to the lid and tapers upwardly to conform to the shape of an upper end of a bottle. The upper and lower sleeves accordingly receive most of the bottle thereby insulating it. When the bottle is discarded, the upper sleeve may be folded into the lower sleeve. A zipper cooperates between the lid and the lower sleeve to enclose the upper sleeve and provide a convenient package for transportation and display.

11 Claims, 1 Drawing Sheet

FOLD UP INSULATED BOTTLE HOLDER

This invention relates to an insulated beverage holder and, more particularly, to such a device which holds a bottle and which may be folded up for transport or storage.

BACKGROUND OF THE INVENTION

Insulated beverage holders are well known in the art for receiving beverage cans or bottles and insulating the contents thereof from rapid. temperature change. The standard insulated beverage holder of the prior art is made of a bodily flexible foam material with a fabric covering and has a circular bottom wall connected to a cylindrical side wall. The standard insulated beverage holder occupies somewhat more than the volume of the container which it is designed to hold, thereby making it inconvenient to ship, display for sale or store between uses. When empty, the standard insulated can holder will stand upright and neither tip over nor will the cylindrical side wall collapse or flex from its own weight.

Another embodiment of a conventional insulated can holder has a split bottom so the sides collapse into a flat structure for storage and transport.

The standard insulated can holder has an open top so the top of the container therein is exposed. There is accordingly considerable heat loss through the exposed top of the container. In addition, openings in the top of the can allow entry of dust, insects and the like. Thus, bees or the like are attracted to sweet liquids in the can and are known to fly into the openings of cans held in standard insulated beverage holders to the consternation of a person drinking from the can. In very dusty situations, a close inspection of the can contents will ruin one's inclination to drink from the can.

Insulated holders for bottles are known in the art. A typical bottle holder comprises a generally cylindrical bottom having a zipper extending upwardly from the bottom. The idea is that, with the zipper open, the bottle may be inserted into the bottom. When the zipper is run up, the holder assumes an upwardly tapering configuration closely receiving the bottle.

SUMMARY OF THE INVENTION

By this invention there is provided an insulated bottle holder which can be collapsed and stowed in a portion of the holder. An insulated bottle holder of this invention includes a generally cylindrical lower sleeve for receiving the bottom of the bottle. The lower sleeve includes a lid and a zipper for closing the lid against the sleeve. The insulated bottle holder also comprises an upper open top generally upwardly tapering sleeve for receiving the upper end of the bottle. The lid of the lower sleeve is secured to the upper sleeve so, when the holder is empty, the upper sleeve can be folded into a stowed position inside the lower sleeve and the zipper manipulated to close the lower sleeve.

It is accordingly an object of this invention to provide an improved insulated bottle holder.

Another object of this invention is to provide an improved insulated bottle holder of multiple components where one of the components may be stowed inside the other.

Another object of this invention is to provide an improved insulated bottle holder where part of the holder provides a receptacle for temporarily receiving another part of the holder sleeve during transport, display and/or non-use.

These and other objects and advantages of this invention will become more fully apparent as this description proceeds, reference being made to the accompanying drawings and appended claims.

DETAILED DESCRIPTION

Figure 1:
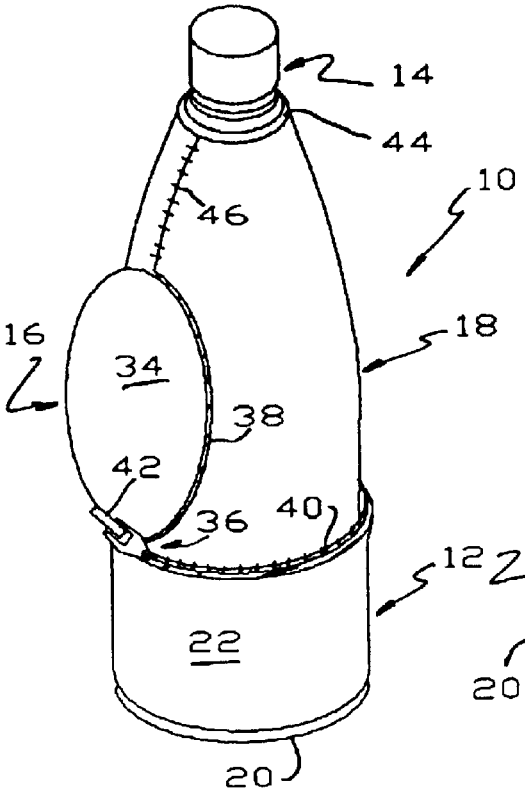
FIG. 1 is an isometric view of an insulated bottle holder of this invention, showing a bottle received in the holder.
Figure 2:
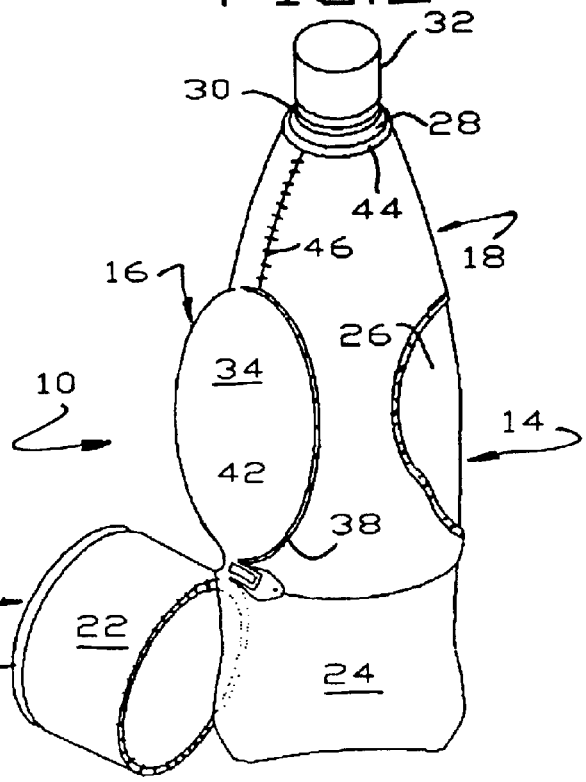
FIG. 2 is another isometric view of the insulated bottle holder of this invention showing the bottom removed from the bottle.
Figure 3:
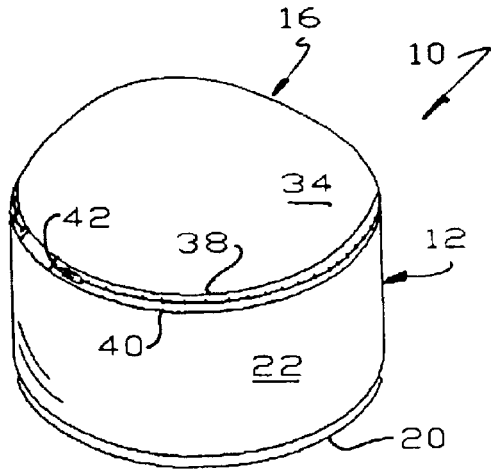
FIG. 3 is an isometric view of the insulated bottle holder of this invention in a stowed position.

Referring to FIGS. 1–3, an insulated bottle holder 10 of this invention comprises, as major components, a lower sleeve 12 for receiving a lower portion of a container 14 of conventional size and shape, a lid 16 for selectively closing the top of the lower sleeve 12 and an upper sleeve 18 for receiving an upper portion of the container 14. The insulated holder 10 is made of any suitable material such as a foam having a fabric covering on the inside and out. Such materials are well known in the art and are commercially available.

The lower sleeve 12 is conveniently of a generally cylindrical shape having a bottom wall 20 and a cylindrical side wall 22 of a size to fit snugly over the outside of the bottom 24 of the container 14. Because the lower sleeve 12 acts as a receptacle for the balance of the beverage holder 10 and is normally not folded, the bottom wall 20 is conveniently of a continuous piece, as compared to the construction in U.S. Pat. No. 6,349,846 where the bottom is slit. It will be seen that the lid 16 closes the top of the open top sleeve 12 in the stowed configuration of the beverage holder 10, as shown in FIG. 3. The lower sleeve 12 is of a conventional height to expose a preferred portion 26 of the beverage container 14.

The container 14 is preferably a bottle and the size of the lower sleeve 12 and the size and shape of the upper sleeve 18 is designed to snugly fit the size and shape of the corresponding section 26 of the bottle 14. The bottle 14 includes a neck 28 having an externally threaded spout or outlet 30 and a screw cap 32 closing the outlet 30.

The lid 16 includes a flat top 34 sized and shaped to close the open top of the lower sleeve 12 and connects to the lower sleeve 12 so the lid 16 is movable or pivotable relative to the lower sleeve 12. The top 34 of the lid 16 is continuous to provide a suitable area for advertising material. A closure 36 is provided to secure the lid 16 to the lower sleeve 12. The closure 36 may be of any suitable type such as a zipper having one track 38 sewn to the lid 16, a second track 40 sewn to the upper edge of the lower sleeve 12 and a slide fastener 42 connecting and disconnecting the tracks 38, 40 in a conventional manner. It will accordingly be seen that the zipper 36 extends less than 360° around the sleeve 12 thereby providing a hinge connecting the lid 16 and the lower sleeve 12 allowing the lid 16 to pivot relative to the sleeve 12.

The upper sleeve 18 is sized and shaped to snugly fit the bottle 14 with which the holder 10 is to be used. The upper sleeve 18 provides a large area for receiving one or more advertising messages. Although the top of the holder 10 may be closed by a suitable closing device, it is preferred to provide an open top 44 sufficiently large to pass the bottle outlet 30 and screw cap 32. Thus, the upper sleeve 18 is typically upwardly tapering and usually has a frustoconical section matching the profile of the bottle 14 with which the holder 10 is to be used. The upper sleeve 18 is normally made of a sheet of the foamed fabric material sewn together along a seam 46. In any event, the upper sleeve 18 is preferably continuous and uninterrupted by a zipper or other comparable closure.

The lid 16 is connected to the upper sleeve 18 by sewing, by the use of adhesives or other suitable technique at a location so that the lower sleeve 12 is able to slip over the lower bottle section 24 and the upper sleeve 18 is able to slip over the upper bottle section 26. In addition, it is preferred that the lower and upper sleeves 12, 18 cover essentially all of the bottle 14 to minimize heat transfer across the holder 10.

Use of the insulated beverage container 10 should now be apparent. From the stowed position of FIG. 3, the zipper 36 is unzipped, the lid 16 is moved away from the sleeve 12 and the upper sleeve 18 is removed from inside the lower sleeve 12. Because the material of the holder 10 is bodily flexible, the upper sleeve 18 may be unfolded to a size to receive the upper end 26 of the bottle 14 as shown in FIG. 2. The lower sleeve 12 is then pulled over the lower bottle end 24 as shown by a comparison of FIGS. 1 and 2. In order to drink from the bottle 14, the screw cap 32 is removed and bottle tilted so the contents pour out through the spout 30.

Manipulating the holder 10 to its stowed position of FIG. 3 is essentially the reverse of installing it on a bottle. First, the lower sleeve 12 is pulled off the lower bottle end 24 as shown by a comparison of FIGS. 1 and 2. The bottle 14 is then pulled out of the sleeve 18. The upper sleeve 18 is then folded on itself to a size that is passed into the lower sleeve 12. The lid 16 is then folded to juxtapose the upper edge of the lower sleeve 12 and the zipper 36 is closed by aligning the tracks 36, 38 and pulling on the slide 42 in a conventional manner. The holder 10 may thus be stowed, transported or displayed in a desirable configuration.

The holder 12 is a convenient device to insulate the bottle 14 and allow drinking from the bottle 14 by simply removing the screw cap 32 and drinking from the outlet 30. There is sufficient area on the holder 10 to provide for advertising messages and the like.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. An insulated bottle holder comprising an open top lower sleeve made of a thermally insulating material for receiving a bottom of a bottle, a lid attached to the lower sleeve for movement between a position covering the open top lower sleeve and an upright position and an open bottom open top upper sleeve for receiving an upper portion of the bottle and providing access to the bottle through the open top, the upper sleeve being connected to the lid and collapsed in a stowed position inside the lower sleeve.

2. The insulated bottle holder of claim 1 further comprising a closure for securing the lid to the lower sleeve.

3. The insulated bottle holder of claim 2 wherein the closure comprises a zipper.

4. The insulated bottle holder of claim 2 wherein the upper sleeve is upwardly tapered having a larger bottom than top.

5. The insulated bottle holder of claim 4 wherein the upper sleeve terminates in an always open passage for receiving a neck of the bottle.

6. The insulated bottle holder of claim 1 wherein the upper sleeve includes a frustoconical section.

7. The insulated bottle holder of claim 1 wherein the lower sleeve includes a flat continuous bottom having a peripheral edge and a skirt extending completely around the peripheral edge and projecting therefrom to receive a bottom section of the bottle.

8. The insulated bottle holder of claim 7 wherein the bottom is circular and the skirt is cylindrical.

9. The insulated bottle holder of claim 7 wherein the lid includes a flat continuous face.

10. The insulated bottle holder of claim 1 wherein the upper sleeve including a long dimension aligned with bottle height and a peripheral dimension around the bottle, the upper sleeve being a peripherally continuous member free of an openable closure extending in the long dimension.

11. An insulated bottle holder comprising an open top lower sleeve made of a thermally insulating material for receiving a bottom of a bottle, a lid attached to the lower sleeve for movement between a position covering the open top lower sleeve and an upright position and an open bottom open top upper sleeve for receiving an upper portion of the bottle and providing access to the bottle through the open top, the upper sleeve including a long dimension aligned with bottle height and a peripheral dimension around the bottle, the upper sleeve being a peripherally continuous member free of an openable closure extending in the long dimension.

* * * * *